US009776816B2

(12) United States Patent
Moriya et al.

(10) Patent No.: US 9,776,816 B2
(45) Date of Patent: Oct. 3, 2017

(54) TRANSPORT DEVICE PROVIDED WITH MECHANISM FOR DERIVING THICKNESS OF RECORDING MEDIUM TO BE TRANSPORTED, AND IMAGE FORMING APPARATUS PROVIDED WITH SAME

(71) Applicant: FUJI XEROX CO., LTD., Tokyo (JP)

(72) Inventors: Hideki Moriya, Kanagawa (JP); Hidehiko Yamaguchi, Kanagawa (JP); Takanori Morino, Kanagawa (JP); Tsuyoshi Sunohara, Kanagawa (JP); Takahito Chiba, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 14/924,353

(22) Filed: Oct. 27, 2015

(65) Prior Publication Data

US 2016/0368724 A1 Dec. 22, 2016

(30) Foreign Application Priority Data

Jun. 22, 2015 (JP) ..... 2015-125051

(51) Int. Cl.

| | |
|---|---|
| ***B65H 7/12*** | (2006.01) |
| ***B65H 5/06*** | (2006.01) |
| ***B65H 7/02*** | (2006.01) |

(52) U.S. Cl.

CPC ..... *B65H 5/062* (2013.01); *B65H 7/02* (2013.01); *B65H 2511/13* (2013.01); *B65H 2513/50* (2013.01); *B65H 2515/702* (2013.01)

(58) Field of Classification Search

CPC ..... B65H 2407/30; B65H 2511/13; B65H 2511/16; B65H 2511/50; B65H 2513/512; B65H 2553/80; B65H 25/00; B65H 7/00; B65H 7/02; B65H 7/20

See application file for complete search history.

(56) References Cited

U.S. PATENT DOCUMENTS 6,827,347 B2 * 12/2004 Ito ..... B65H 29/46 271/213
2005/0078994 A1 * 4/2005 Suzuki ..... G03G 15/5029 399/389

(Continued)

FOREIGN PATENT DOCUMENTS

JP 2003-029555 A 1/2003
JP 2003-285484 * 10/2003
JP 2003-285484 A 10/2003

(Continued)

OTHER PUBLICATIONS

Machine translation of JP2003-285484.*

(Continued)

*Primary Examiner* — Thomas Morrison
(74) *Attorney, Agent, or Firm* — Sughrue Mion, PLLC

(57) ABSTRACT

Provided is a transport device including a transport unit that transports a recording medium by interposing the recording medium, a driving unit that drives the transport unit, a detection unit that detects a peak value of a load of the driving unit when the recording medium is discharged from the transport unit, and a derivation unit that derives a thickness of the recording medium based on the peak value detected by the detection unit.

8 Claims, 5 Drawing Sheets

(56) References Cited

U.S. PATENT DOCUMENTS

| | | | | |
|---|---|---|---|---|
| 2010/0226676 | A1* | 9/2010 | Funamoto | G03G 15/161 399/66 |
| 2015/0360892 | A1* | 12/2015 | Yoshimizu | B65H 5/068 271/3.16 |

FOREIGN PATENT DOCUMENTS

| | | | |
|---|---|---|---|
| JP | 2004-018127 | A | 1/2004 |
| JP | 2005-148767 | A | 6/2005 |

OTHER PUBLICATIONS

Communication dated Dec. 8, 2015, issued by the Japan Patent Office in corresponding Japanese Application No. 2015-125051.
Communication dated Jan. 10, 2017, from the Japanese Patent Office in counterpart Japanese application No. 2016-008769.
Communication dated Jul. 12, 2016, issued by the Japan Patent Office in corresponding Japanese Application No. 2016-008769.
Communication dated Oct. 6, 2015 from the Japanese Patent Office in counterpart application No. 2015-125051.

* cited by examiner

TRANSPORT DEVICE PROVIDED WITH MECHANISM FOR DERIVING THICKNESS OF RECORDING MEDIUM TO BE TRANSPORTED, AND IMAGE FORMING APPARATUS PROVIDED WITH SAME

CROSS-REFERENCE TO RELATED APPLICATIONS

This application is based on and claims priority under 35 USC 119 from Japanese Patent Application No. 2015-125051 filed Jun. 22, 2015.

BACKGROUND

Technical Field

The present invention relates to a transport device provided with a mechanism for deriving the thickness of a recording medium to be transported, and an image forming apparatus provided with the same.

SUMMARY

According to an aspect of the invention, there is provided a transport device including:

a transport unit that transports a recording medium by interposing the recording medium;

a driving unit that drives the transport unit;

a detection unit that detects a peak value of a load of the driving unit when the recording medium is discharged from the transport unit; and a derivation unit that derives a thickness of the recording medium based on the peak value detected by the detection unit.

BRIEF DESCRIPTION OF THE DRAWINGS

Exemplary embodiments of the present invention will be described in detail based on the following figures, wherein.

DETAILED DESCRIPTION

Figure 1:
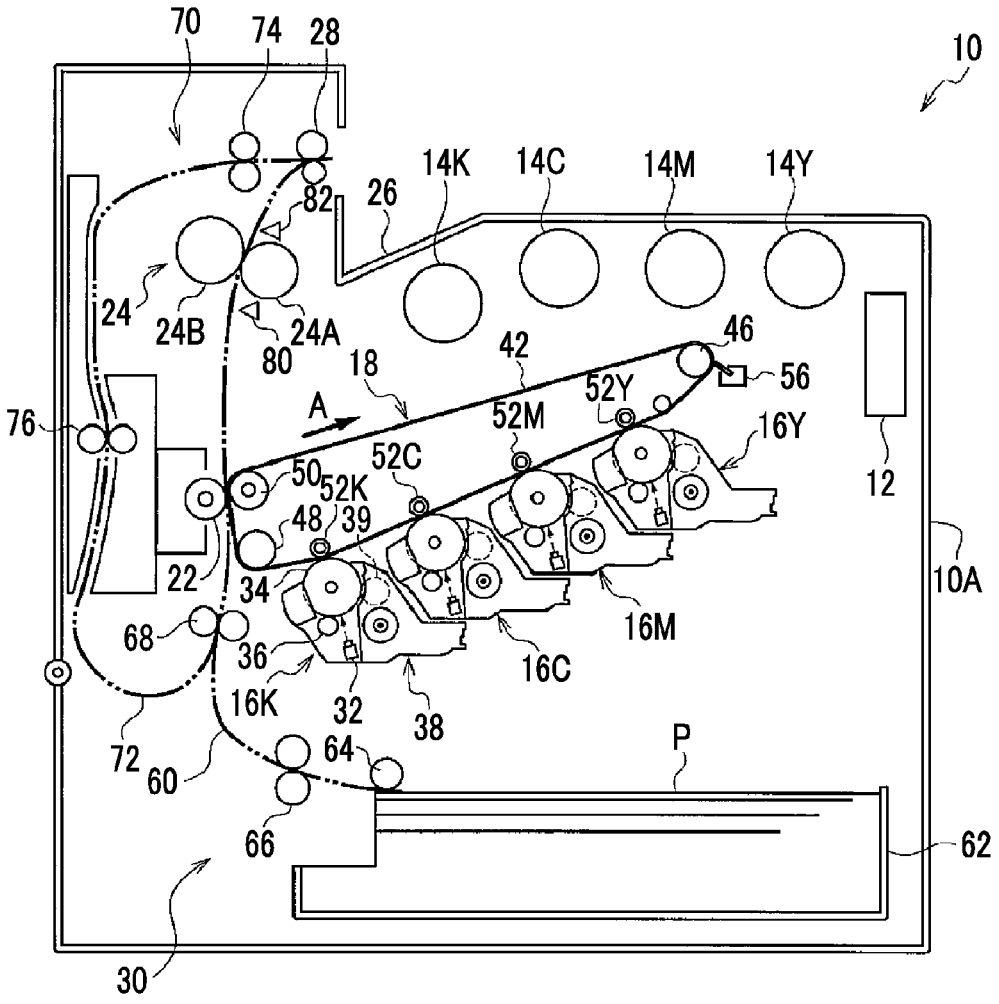
FIG. 1 is a schematic configuration diagram illustrating the configuration of an image forming apparatus according to each exemplary embodiment.

Hereinafter, exemplary embodiments for implementing the present invention will be described in detail with reference to the accompanying drawings.

First Exemplary Embodiment

First, the configuration of an image forming apparatus 10 according to the present exemplary embodiment will be described with reference to FIG. 1. In addition, in the following description, yellow, magenta, cyan, and black are respectively denoted by Y, M, C, and K. If it is necessary to distinguish respective components and toner images (images) for the respective colors, a description will be made by attaching the sign of color (Y, M, C, and K) corresponding to each color at the end of a reference numeral. Further, if respective components and toner images are collectively referred to, without distinguishing for respective colors in the following description, the description will be made by omitting the sign of color at the end of the reference numeral.

Entire Configuration

As illustrated in FIG. 1, an image processing unit 12 that performs an image process of converting input image data into tone data of four colors Y, M, C, and K is provided in the inside of an apparatus main body 10A of the image forming apparatus 10.

Further, image forming units 16 forming toner images of respective colors are spaced apart in a direction that is inclined relative to a horizontal direction, on the center side of the apparatus main body 10A. Further, a first transfer unit 18 to which the toner images formed by the image forming units 16 of respective colors are multiply transferred is provided above the image forming units 16 of respective colors in the vertical direction.

Further, a second transfer roll 22 that transfers the toner images that have been multiply transferred to the first transfer unit 18, to paper P which is an example of a recording medium that is transported along a transporting path 60 by a supply and transport unit 30 to be described later, is provided in the side portion (the left side in FIG. 1) of the first transfer unit 18.

A fixing device 24 is provided as an example of a transport unit that transports the paper P by interposing an image formed surface of the paper P therein, on the downstream side of the transport direction of the paper P (hereinafter, referred to as "paper transport direction") relative to the second transfer roll 22. Further, the fixing device 24 fixes the toner image that has been transferred to the paper P, on the paper P, with heat and pressure.

The fixing device 24 according to the present exemplary embodiment is provided with a heat belt 24A and a pressure roll 24B. The fixing device 24 is a device of a type which heats the heat belt 24A using electromagnetic induction, that is, a so-called induction heating (IH) fixing device. Further, the pressure roll 24B is driven (rotated) by a motor 112 (see FIG. 2) which is an example of a driving unit, and the heat belt 24A is moved and rotated according to the rotation of the pressure roll 24B.

Further, an exit roll 28 is provided on the downstream side of the paper transport direction relative to the fixing device 24, and discharges the paper P in which the toner image is fixed, to an exit unit 26 provided in the upper portion of the apparatus main body 10A of the image forming apparatus 10.

Meanwhile, the supply and transport unit 30 that supplies and transports the paper P is provided on the lower side and the side of the image forming unit 16 in the vertical direction. Further, a toner cartridge 14 is detachable from the apparatus main body 10A from the front surface of the apparatus main body 10A and is charged with toners to be replenished to a developing device 38. Toner cartridge 14 (14K to 14Y) of four pieces for respective colors are arranged side by side in an apparatus width direction, on the upper side of the first transfer unit 18 in the vertical direction. Each toner cartridge 14 of each color has a cylindrical shape extending in an apparatus depth direction, and is connected to the developing device 38 of each color through a replenishing pipe, not illustrated.

Image Forming Unit

As illustrated in FIG. 1, all image forming units 16 of respective colors have the same configuration. Then, the image forming unit 16 includes a cylindrical image holding member 34 that rotates, and a charger 36 that charges the surface of the image holding member 34.

Further, the image forming unit 16 includes a light emitting diode (LED) head 32 that emits exposure light to the surface of the charged image holding member 34. Further, the image forming unit 16 includes the developing device 38 that develops an electrostatic latent image that is formed by the irradiation of the exposure light by the LED head 32 by a developer (a toner charged to the negative electrode, in the present exemplary embodiment) to visualize the image as the toner image. Further, the image forming unit 16 includes a cleaning blade, not illustrated, that cleans the surface of the image holding member 34.

A developing roll 39 is arranged facing the image holding member 34 in the developing device 38, and the developing device 38 develops the electrostatic latent image formed in the image holding member 34 by using the developing roll 39 by a developer, and visualizes the image as a toner image.

Then, the charger 36, the LED head 32, the developing roll 39, and the cleaning blade are opposed to the surface of the image holding member 34, and arranged from the upstream side to the downstream side of the rotation direction of the image holding member 34, in this order.

Transfer Unit (First Transfer Unit and Second Transfer Roll)

The first transfer unit 18 includes an endless intermediate transfer belt 42, and a driving roll 46 around which the intermediate transfer belt 42 is wound and which is rotated and driven by a motor, not illustrated, to cause the intermediate transfer belt 42 to revolve in an arrow A direction. Further, the intermediate transfer belt 42 is wound around the first transfer unit 18 including a tensioning roll 48 that applies tension to the intermediate transfer belt 42, and an assist roll 50 that is disposed above the tensioning roll 48 in the vertical direction and is rotated according to the intermediate transfer belt 42. Further, the first transfer unit 18 is provided with first transfer rolls 52 which are respectively arranged on the opposite side of the image holding members 34 of respective colors across the intermediate transfer belt 42.

With the above configuration, toner images of respective colors of Y, M, C, and K that have been sequentially formed on the image holding member 34 of the image forming units 16 of the respective colors are multiply transferred to the intermediate transfer belt 42, by the first transfer rolls 52 of the respective colors.

Further, a cleaning blade 56 that is in contact with the surface of the intermediate transfer belt 42 and cleans the surface of the intermediate transfer belt 42 is disposed on the opposite side of the driving roll 46 across the intermediate transfer belt 42.

Further, the second transfer roll 22 that transfers the toner image that has been transferred to the intermediate transfer belt 42 to the paper P to be transported is provided on the opposite side of the assist roll 50 across the intermediate transfer belt 42. Then, the second transfer roll 22 is grounded, and the assist roll 50 forms a counter electrode of the second transfer roll 22. If a second transfer voltage is applied to the assist roll 50, a toner image is transferred to the paper P. Further, in the present exemplary embodiment, the transport speed of the paper P by the second transfer roll 22 and the intermediate transfer belt 42 is faster than the transport speed of the paper P by the fixing device 24.

Supply and Transport Unit

The supply and transport unit 30 is disposed below the image forming unit 16 in the vertical direction, in the inside of the apparatus main body 10A, and includes a paper feeding member 62 on which plural sheets of paper P are stacked.

Further, the supply and transport unit 30 includes a paper feeding roll 64 that sends out the paper P stacked in the paper feeding member 62 to the transporting path 60, a separation roll 66 that separates the paper P that has been supplied by the paper feeding roll 64 one by one, and a positioning roll 68 that adjusts the transport timing of the paper P. Then, the respective rolls are arranged in this order from the upstream side to the downstream side of the paper transport direction.

Further, the positioning roll 68 is connected to a motor rotating and driving the positioning roll 68 through a clutch mechanism, not illustrated. The image forming apparatus 10 causes the clutch mechanism to be in an unconnected state until the paper P reaches the installation position of the positioning roll 68, and causes the leading edge of the paper P in the paper transport direction to abut on the positioning roll 68. As a result, the image forming apparatus 10 performs positioning by correcting the inclination of the paper P relative to the paper transport direction. Then, the positioning roll 68 is rotated and the paper P is transported, by causing the clutch mechanism to be in a connected state, after the positioning. In addition, the positioning roll 68 is an example of a correction unit of the present invention.

With the above configuration, the paper P that has been fed from the paper feeding member 62 is sent out to the contact portion (second transfer position) between the intermediate transfer belt 42 and the second transfer roll 22, by the rotating positioning roll 68, at defined timing.

Then, the paper P that has been transported to the fixing device 24 is excessively heated by the heat belt 24A, and is pressurized by the heat belt 24A and the pressure roll 24B, and thus the toner image is fixed on one surface (image formed surface) of the paper P.

Further, the supply and transport unit 30 is provided with a duplex transport device 70 that does not discharge the paper P of which one surface has been fixed with the toner image by the fixing device 24 as it is, to the exit unit 26 by the exit roll 28, but rather uses the paper P to form a toner image on the other side thereof.

The duplex transport device 70 is provided with a duplex transporting path 72 along which the front and back of the paper P is inverted at the exit roll 28 toward the positioning roll 68 and transported, and a transport roll 74 and a transport roll 76 that transport the paper P along the duplex transporting path 72.

(Others)

The image forming apparatus 10 includes a paper detection sensor 80 provided on the upstream side of the paper transport direction of the fixing device 24 along the transporting path 60, and a paper detection sensor 82 provided on the downstream side. The paper detection sensors 80, 82 according to the present exemplary embodiment are a reflection type sensor provided with a pair of a light emitting element and a light receiving element, as an example. The paper detection sensors 80, 82 emit light to a detection position on the transporting path 60 corresponding to the installation position from the light emitting element. Further, the paper detection sensors 80, 82 output a signal (hereinafter, referred to as "detection signal") of a signal level corresponding to the light amount received by the light receiving element. During a period at which the paper P is passed through the detection position, the light emitted from the light emitting element is reflected on the paper P. Therefore, the paper detection sensor 80, 82 output detection signals of different levels in the period at which the paper P is passed through the detection position and the period at which the paper P is not passed through the detection position.

In this manner, in the present exemplary embodiment, the reflection type sensor is applied as the paper detection sensors 80 and 82, but without being limited thereto, for example, other sensors such as a transmission type sensor may be applied.

Image Forming Step

First, tone data for each color is sequentially output from the image processing unit 12 to the LED head 32 for each color. Then, the surface of the image holding member 34 that is charged by the charger 36 is irradiated with the exposure light emitted from the LED head 32 depending on the tone data. Thus, an electrostatic latent image is formed on the surface of the image holding member 34. The electrostatic latent image formed on the image holding member 34 is developed by the developing device 38 of each color, and is visualized as a toner image of each of colors Y, M, C, and K.

Further, the toner image of each color formed on the image holding member 34 is multiply transferred to the intermediate transfer belt 42 that revolves, by the first transfer roll 52 of the first transfer unit 18.

The toner image of each color that has been multiply transferred to the intermediate transfer belt 42 is second transferred to the paper P which is transported along the transporting path 60 by the paper feeding roll 64, the separation roll 66, and the positioning roll 68 from the paper feeding member 62, in the second transfer position, by the second transfer roll 22.

Further, the paper P to which the toner image has been transferred is transported to the fixing device 24. Then, the toner image is fixed on the paper P by the fixing device 24. The paper P on which the toner image has been fixed is discharged to the exit unit 26 by the exit roll 28.

Meanwhile, when forming an image on both sides of the paper P, the paper P of which one side (front surface) has been fixed with the toner image by the fixing device 24 is not discharged as it is, to the exit unit 26 by the exit roll 28. Since the exit roll 28 is reversely rotated, the transport direction of the paper P is switched. Then, the paper P is transported along the duplex transporting path 72 by the transport rolls 74, 76.

The back and front of the paper that has been transported through the duplex transporting path 72 is inverted, and the paper is transported again to the positioning roll 68. After the toner image is transferred to and fixed on the other side (back surface) of the paper P, the paper P is discharged to the exit unit 26 by the exit roll 28.

Next, main components of an electric system of the image forming apparatus 10 according to the present exemplary embodiment will be described with reference to FIG. 2.

Figure 2:
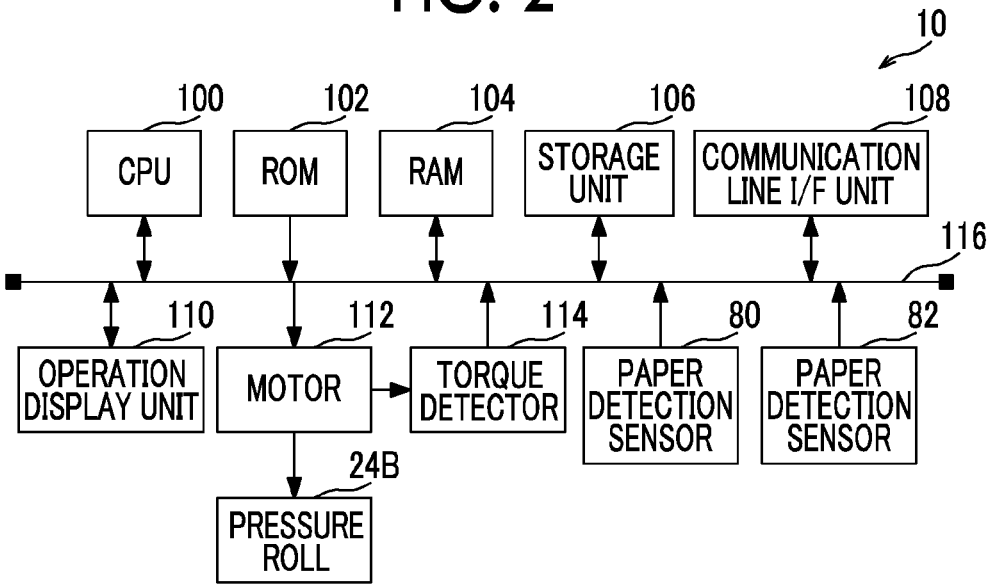
FIG. 2 is a block diagram illustrating a main configuration of an electric system of the image forming apparatus according to each exemplary embodiment.

As illustrated in FIG. 2, the image forming apparatus 10 according to the present exemplary embodiment includes a central processing unit (CPU) 100 which controls the overall operation of the image forming apparatus 10, and a read only memory (ROM) 102 which stores in advance various programs, various parameters, and the like. Further, the image forming apparatus 10 includes a random access memory (RAM) 104 which is used as a work area during execution of various programs by the CPU 100, and a non-volatile storage unit 106 such as a flash memory.

Further, the image forming apparatus 10 includes a communication line Interface (I/F) unit 108 that performs transmission and reception of communication data with an external device. Further, the image forming apparatus 10 includes an operation display unit 110 that receives an instruction from the user for the image forming apparatus 10, and displays various information about the operating status of the image forming apparatus 10 to the user. In addition, the operation display unit 110 includes, for example, a display in which a touch panel is provided on a display surface displaying display buttons receiving operation instructions and various information by the execution of a program, and hardware keys such as a numeric keypad or a start button.

Further, the image forming apparatus 10 is provided with a torque detector 114 which is an example of a detection unit that detects the load (torque) of the motor 112 rotating and driving the pressure roll 24B. The torque detector 114 according to the present exemplary embodiment is connected to the motor 112, detects the torque of the motor 112 as a current value flowing through the motor 112, and outputs a voltage value acquired by converting the current value.

In addition, the configuration of the torque detector 114 according to the present exemplary embodiment is not particularly limited as long as the torque detector 114 is able to detect the torque of the motor 112. For example, a configuration of detecting a current by measuring the voltage across a shunt resistor may be applied as the torque detector 114. Further, for example, a configuration in which a resistor is provided on the path through which a current flows to the motor 112, and a current is detected by measuring the voltage across the resistor may be applied as the torque detector 114. Further, for example, a configuration in which a current sensor using a Hall element is provided on the path through which a current flows to the motor 112 and a current is detected may be applied as the torque detector 114. Further, for example, a torque detector that detects the torque of the motor 112 may be applied as the torque detector 114.

Then, the respective parts of the CPU 100, the ROM 102, the RAM 104, the storage unit 106, the communication line I/F unit 108, the operation display unit 110, the motor 112, the torque detector 114, and the paper detection sensors 80, 82 are connected to each other through a bus 116 such as an address bus, a data bus, and a control bus.

With the above configuration, the image forming apparatus 10 according to the present exemplary embodiment performs an access to the ROM 102, the RAM 104, and the storage unit 106, and transmission and reception of communication data with an external device through the communication line I/F unit 108, by the CPU 100, respectively. Further, the image forming apparatus 10 performs acquisition of various instruction information through the operation display unit 110, and displays various information on the operation display unit 110, by the CPU 100, respectively. Further, the image forming apparatus 10 performs the control of the motor 112, and acquisition of the voltage value that is output from the torque detector 114, by the CPU 100, respectively.

Further, the image forming apparatus 10 acquires each of the detection signals which are output respectively from the paper detection sensors 80, 82, by the CPU 100. Therefore, the image forming apparatus 10 detects the timing at which the leading edge and the trailing edge of the paper P in the paper transport direction pass through the detection position of each of the paper detection sensors 80, 82, depending on a change in the signal level of the acquired detection signal, by the CPU 100. Hereinafter, the leading edge and the trailing edge of the paper P in the paper transport direction will be simply referred to as the leading edge and the trailing edge of the paper P.

Incidentally, a detection function of detecting the thickness of the paper P is installed in the image forming apparatus 10 according to the present exemplary embodiment.

Figure 3:
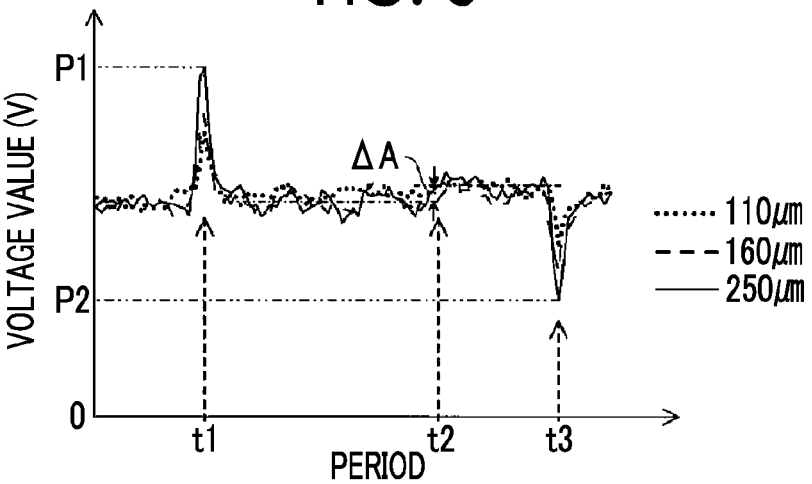
FIG. 3 is a graph illustrating an example of time series data of a detection result by a torque detector according to each exemplary embodiment.
Figure 4:
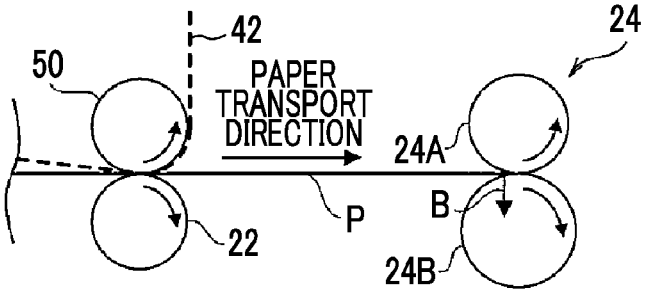
FIG. 4 is a schematic configuration diagram for explaining timing when paper enters a fixing device, according to each exemplary embodiment.
Figure 5:
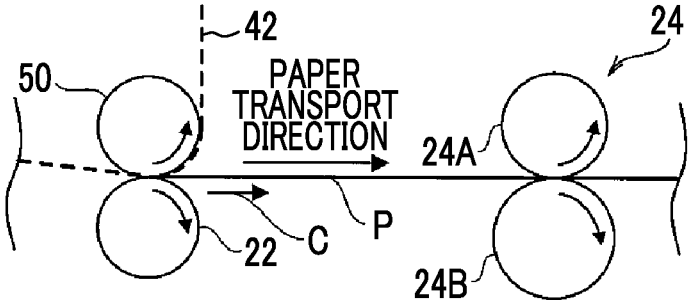
FIG. 5 is a schematic configuration diagram for explaining timing when paper is discharged from a second transfer roll and an intermediate transfer belt, according to each exemplary embodiment.
Figure 6:
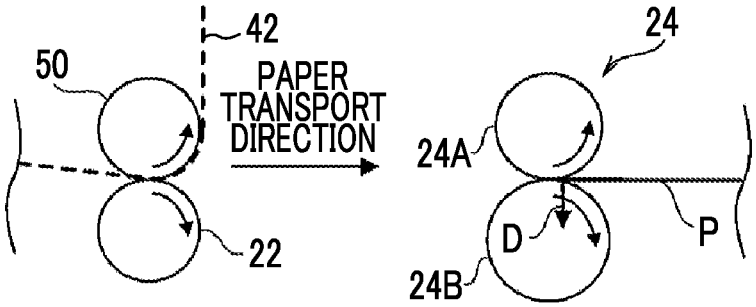
FIG. 6 is a schematic configuration diagram for explaining timing when paper is discharged from the fixing device, according to each exemplary embodiment.
Figure 7:
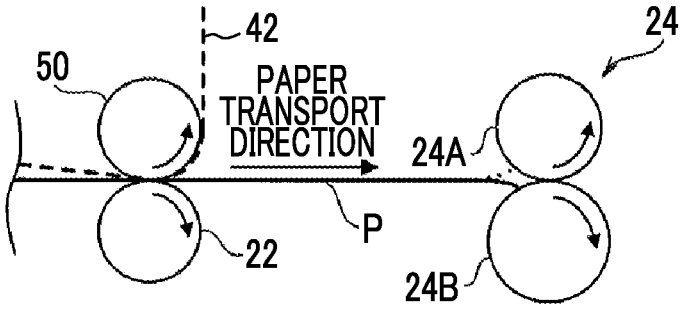
FIG. 7 is a schematic configuration diagram for explaining noise at timing when paper enters the fixing device, according to each exemplary embodiment.

The detection function will be described in detail with reference to FIGS. 3 to 7. In addition, FIG. 3 illustrates the time series data of the voltage value that is output from the torque detector 114 for the paper P of three types of thickness, until the trailing edge of the paper P has passed the detection position by the paper detection sensor 82 since the leading edge of the paper P has passed the detection position by the paper detection sensor 80. Further, FIGS. 4 to 6 are diagrams for explaining the time series data of the voltage value illustrated in FIG. 3, which illustrate the transport positions of the paper P. Further, FIG. 7 is a diagram for explaining the noise occurring when the paper P enters the fixing device 24. Further, in FIGS. 4 to 7, the intermediate transfer belt 42 is denoted by a broken line, in order to avoid complication.

First, as illustrated in FIG. 3, the voltage value that is output from the torque detector 114 is an upwardly convex peak value P1 at a timing t1, is a value greater than its previous value at a timing t2, and is a downwardly convex peak value P2 at a timing t3. In addition, in FIG. 3, the variation amount between the average values of the voltage values before and after the timing t2 is denoted by AA.

Next, the principle of a change in the time series of the voltage value illustrated in FIG. 3 will be described with reference to FIGS. 4 to 6.

As illustrated in FIG. 4, when the paper P enters the fixing device 24, the force in a direction (the force of the arrow B in FIG. 4) reverse to the rotation direction of the pressure roll 24B acts on the pressure roll 24B, and the torque of the motor 112 is increased. Therefore, the voltage value that is output by the torque detector 114 is increased to a peak value P1. Thereafter, since the paper P is sandwiched in the fixing device 24 and transported, and the force of the reverse direction occurring when the paper P enters the fixing device 24 does not act, the voltage value is reduced.

Next, as illustrated in FIG. 5, when the paper P is discharged from the intermediate transfer belt 42 and the second transfer roll 22 in the upstream of the fixing device 24, a force that pushes out the paper P (force of the arrow C in FIG. 5) makes the force that has acted on the pressure roll 24B in the rotation direction no longer act. Therefore, the torque of the motor 112 is increased, and the voltage value that is output by the torque detector 114 is increased (AA illustrated in FIG. 3). In addition, it is considered that the force pushing out the paper P is generated due to the transport speed of the paper P by the second transfer roll 22 and the intermediate transfer belt 42 being faster than the transport speed of the paper P by the fixing device 24.

Further, as illustrated in FIG. 6, when the paper P is discharged from the fixing device 24, a force (force of the arrow D in FIG. 5) in the same direction of the rotation direction of the pressure roll 24B acts on the pressure roll 24B, the torque of the motor 112 is reduced. Therefore, the voltage value that is output by the torque detector 114 is reduced to a peak value P2.

In other words, the timing t1 illustrated in FIG. 3 is a timing when the paper P enters the fixing device 24 illustrated in FIG. 4, the timing t2 is a timing when the paper P is discharged from the intermediate transfer belt 42 and the second transfer roll 22 illustrated in FIG. 5, and the timing t3 illustrated in FIG. 3 is a timing when the paper P is discharged from the fixing device 24, illustrated in FIG. 6.

Further, as illustrated in FIG. 3, the thicker the paper P is, the larger the value of the peak value P1 is. The thicker the paper P is, the smaller the value of the peak value P2 is. Further, the thicker the paper P is, the larger the variation amount ΔA is.

However, when the variation amount ΔA is smaller as compared to the peak values P1, P2, and the paper P is relatively thin, it is difficult to accurately derive the thickness of the paper P.

Meanwhile, as illustrated in FIG. 7, when the paper P enters the fixing device 24, the position of the leading edge of the paper P in the up and down direction may be changed, due to the curling of the paper P, or the leading edge of the paper P being flapped in the up and down direction of FIG. 7. In this case, when the paper P enters the fixing device 24, noise due to a change in the position of the leading edge of the paper P in the up and down direction may be contained, in other words, an erroneous difference may be acquired due to the attitude of the paper, in the voltage value that is output from the torque detector 114. Accordingly, when the thickness of the paper P is derived based on the peak value P1, the derived thickness of the paper P may be affected by the noise, and in this case, the thickness of the paper P may not be accurately derived.

In contrast, when the paper P is discharged from the fixing device 24, since the paper P is transported by being interposed in the fixing device 24 until the paper P is discharged from the fixing device 24, the position of the trailing edge of the paper P in the up and down direction is not changed. Therefore, when the paper P enters the fixing device 24, the voltage value that is output from the torque detector 114 is not affected by the noise.

Therefore, the image forming apparatus 10 according to the present exemplary embodiment derives the thickness of the paper P based on the peak value P2 of the voltage values that are output from the torque detector 114 when the paper P is discharged from the fixing device 24. In addition, here, the description has been made using an example of applying the minimum value which is an exact top as the peak value P2, but without being limited thereto, a value greater than the minimum value near the minimum value may be applied, and the value is also included in the peak value P2 described above. However, it is preferable to use the minimum value of the acquired measured values, within the range of the measurement rate.

Figure 8:
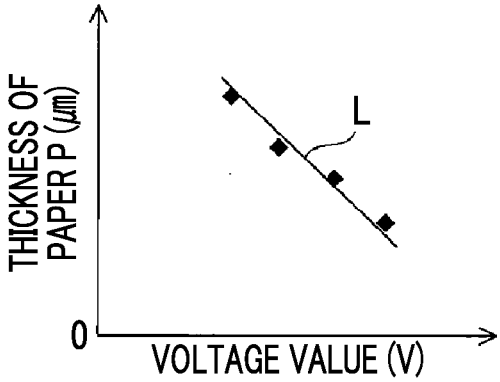
FIG. 8 is a graph illustrating an example of a relationship between a voltage value and the thickness of paper, according to each exemplary embodiment.

Next, with reference to FIG. 8, a description will be made regarding a process of deriving the thickness of a paper P based on the peak value P2 of the voltage value that is output from the torque detector 114 when the paper P is discharged from the fixing device 24.

As described above, the peak value P2 is reduced as the paper P becomes thicker. Therefore, in the present exemplary embodiment, the image forming apparatus 10 measures in advance the voltage values that are output from the torque detector 114 corresponding to the thicknesses of the plural sheets of paper P, by experimentation using the actual image forming apparatus 10 and sheets of paper of the plural thicknesses. Further, as illustrated in FIG. 8, a result that has been obtained through pre-measurement is approximated to the primary straight line L using a least square method or the like. Then, the linear expression corresponding to the primary straight line L expressed by the following Equation (1) is derived in advance, as an operational expression representing a relationship between the thickness T of the paper P and the voltage value that is output from the torque detector 114.

$$T=aV+b \quad \text{[Equation 1]}$$

Then, the image forming apparatus 10 derives the thickness T of the paper P based on the peak value P2 of the voltage values V that are output from the torque detector 114 when the paper P is discharged from the fixing device 24, using Equation (1). In addition, without being limited thereto, for example, the thickness T may be derived using a look up table (LUT) storing the simple peak value P2 and the thickness T of the paper P.

Figure 9:
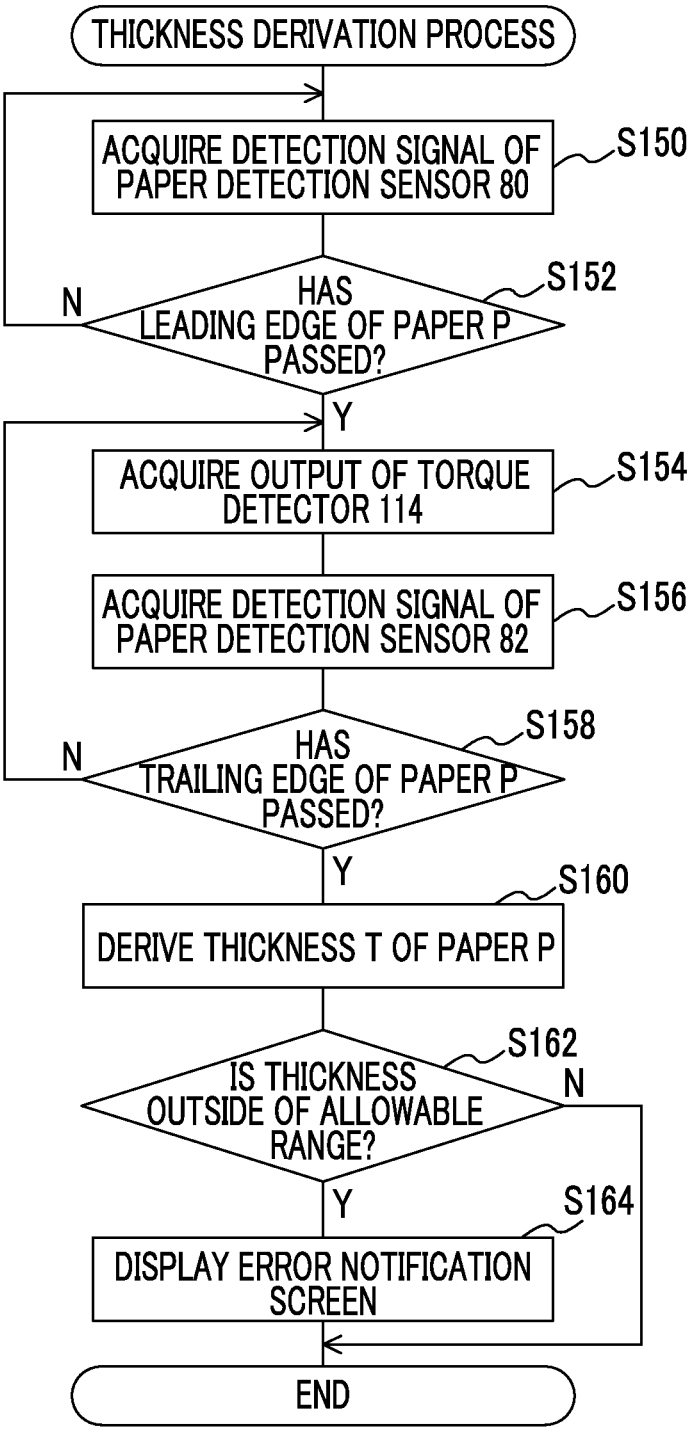
FIG. 9 is a flowchart illustrating a flow of a process of a thickness derivation processing program according to each exemplary embodiment.

Next, the operation of the image forming apparatus 10 according to the present exemplary embodiment at the time of execution of the detection function will be described with reference to FIG. 9. In addition, FIG. 9 is a flowchart illustrating the flow of the process of a thickness derivation processing program executed by the CPU 100, each time an image formation instruction is input to the paper P. Further, the thickness derivation processing program is installed in advance on the ROM 102. Further, here, in order to avoid complication, the description regarding the process of forming an image on the paper P by the aforementioned image forming step will be omitted. Further, here, a description will be made assuming that the thickness of the paper P to be used is previously set by a user, for the image forming apparatus 10.

In step S150 in FIG. 9, the CPU 100 obtains a detection signal that is output from the paper detection sensor 80. In the following step S152, the CPU 100 determines whether or not the leading edge of the paper P has passed the detection position by the paper detection sensor 80 on the transporting path 60, based on the detection signal acquired by the process of step S150. If the determination becomes negative, the CPU 100 returns step S150, and if the determination becomes positive, the CPU 100 proceeds to the process of step S154.

In step S154, the CPU 100 obtains the voltage value V which is output from the torque detector 114. In the following step S156, the CPU 100 obtains the detection signal which is output from the paper detection sensor 82. In the following step S158, the CPU 100 determines whether or not the trailing edge of the paper P has passed the detection position by the paper detection sensor 82 on the transporting path 60, based on the detection signal acquired by the process of step S156. If the determination becomes negative, the CPU 100 returns step S154, and if the determination becomes positive, the CPU 100 proceeds to the process of step S160. The time series data of the voltage value V illustrated in FIG. 3 is acquired by the repetition process of the above step S154 to step S158.

In step S160, the CPU 100 derives the thickness T of the paper P based on the downwardly convex peak value P2 in the time series data of the voltage value V using Equation (1). In the following step S162, the CPU 100 determines whether or not the thickness T of the paper P that is derived by the process of step S160 is outside of the allowable range.

Specifically, in the present exemplary embodiment, as an example, when the absolute value of a difference between the derived thickness T of the paper P and the thickness of the paper P that is set in advance by the user is a predetermined proportion (for example, 10%) or more of the thickness, the CPU 100 determines that the thickness T is outside of the allowable range. If the determination in step S162 is positive, the CPU 100 proceeds to the process of step S164.

In step S164, after displaying an error notification screen indicating that the thickness T of the paper P that is derived by the process of step S160 is outside of the allowable range, on the display of the operation display unit 110, the CPU 100 ends the thickness derivation processing program.

Figure 10:
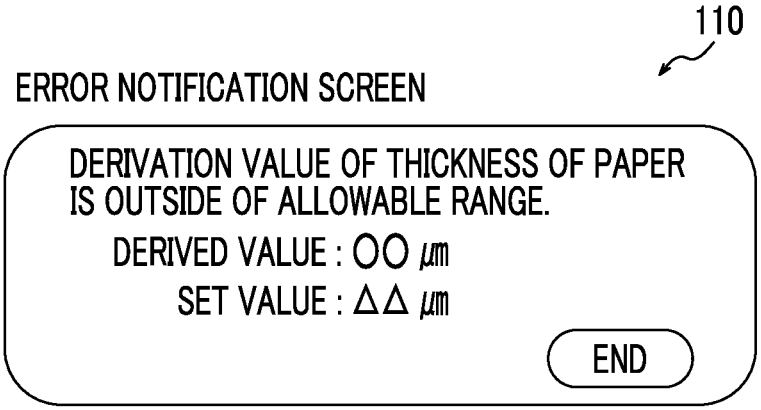
FIG. 10 is a schematic diagram illustrating an example of an error notification screen according to each exemplary embodiment.

FIG. 10 illustrates an example of the error notification screen according to the present exemplary embodiment. As illustrated in FIG. 10, information indicating that the derived thickness T is outside of the allowable range, information indicating the derived thickness T of the paper P, and information indicating the thickness of the paper P that is set in advance by the user are displayed on the error notification screen according to the present exemplary embodiment. Here, if a user wants to end the display of the error notification screen, the user designates an end button that is displayed at the bottom of the error notification screen.

Meanwhile, if the determination in step S162 is negative, the CPU 100 ends the thickness derivation processing program, without executing the process in step S164.

As described above, in the present exemplary embodiment, the thickness of the paper P is derived based on the torque of the motor 112 driving the pressure roll 24B of the fixing device 24. Force to sandwich the image formed surface of the paper P by the fixing device 24 is stronger as compared to other transport units such as a set of the second transfer roll 22 and the intermediate transfer belt 42, the positioning roll 68, and the separation roll 66. Therefore, according to the present exemplary embodiment, the thickness of the paper P is more accurately derived as compared to the case of deriving the thickness of the paper P based on the torque of a motor driving other transport units.

Second Exemplary Embodiment

Hereinafter, a second exemplary embodiment of the present invention will be described in detail. In addition, since the configuration of the image forming apparatus 10 according to the present exemplary embodiment is the same as in the first exemplary embodiment (see FIGS. 1 and 2), a description thereof will be omitted here.

First, the detection function according to the present exemplary embodiment will be described. The image forming apparatus 10 according to the present exemplary embodiment derives the thickness T of the paper P based on a difference between the voltage value V that is output from the torque detector 114 and the peak value P2, during a predetermined period (hereinafter, referred to as "first period") in a period from a timing when the paper P is discharged from the intermediate transfer belt 42 and the second transfer roll 22 to a timing when the paper P is discharged from the fixing device 24. In addition, the period from a timing when the paper P is discharged from the intermediate transfer belt 42 and the second transfer roll 22 to a timing when the paper P is discharged from the fixing device 24 corresponds to a period from the timing t2 to the timing t3, illustrated in FIG. 3. In addition, the intermediate transfer belt 42 and the second transfer roll 22 are an example of the second transport unit of the present invention.

Specifically, the image forming apparatus 10 derives the average value of the voltage values V during the first period. In addition, as long as the first period is within a period from the timing t2 to the timing t3, the first period is not particularly limited. The first period may be a period including the center of the period from the timing t2 to the timing t3 of a predetermined proportion (for example, 50%) to the entire period, may be a period of the proportion immediately following the timing t2, or may be the entire period from the timing t2 to the timing t3.

Then, the image forming apparatus 10 derives the thickness T of the paper P based on a difference between the derived average value and the peak value P2. As illustrated in FIG. 3, the difference between the average value and the peak value P2 is increased as the paper P becomes thicker.

Therefore, in the present exemplary embodiment, similar to the first exemplary embodiment, the image forming apparatus 10 derives in advance a difference between the average value and the peak value P2 which correspond to the thicknesses of the plural sheets of paper P, by experimentation using the actual image forming apparatus 10 and sheets of paper of the plural thicknesses. Further, a linear expression representing a relationship between the thickness T of the paper P and the difference is derived in advance by approximating the pre-derived difference to the primary straight line using the least square method.

Then, the image forming apparatus 10 derives the thickness T of the paper P based on the difference between the average value in the first period and the peak value P2, using the linear expression.

Next, with reference to FIG. 9, the operation of the image forming apparatus 10 according to the present exemplary embodiment at the time of execution of the detection function will be described. In addition, since the operation of the image forming apparatus 10 according to the present exemplary embodiment is different from the first exemplary embodiment in the process of step S160, the process of step S160 will be described here.

In step S160 in FIG. 9, the CPU 100 derives the average value of the voltage values V that are acquired by the process of step S154, within the first period. Then, the CPU 100 derives the thickness T of the paper P based on the difference between the derived average value and the peak value P2, using the linear expression.

Third Exemplary Embodiment

Hereinafter, a third exemplary embodiment of the present invention will be described in detail. In addition, since the configuration of the image forming apparatus 10 according to the present exemplary embodiment is the same as in the first exemplary embodiment (see FIGS. 1 and 2), a description thereof will be omitted here.

First, the detection function according to the present exemplary embodiment will be described. The image forming apparatus 10 according to the present exemplary embodiment derives the thickness T of the paper P based on a difference between the peak value P1 and the peak value P2.

As illustrated in FIG. 3, the difference between the peak value P1 and the peak value P2 is increased as the paper P becomes thicker.

Therefore, in the present exemplary embodiment, similar to each exemplary embodiment, the image forming apparatus 10 derives in advance a difference between the peak value P1 and the peak value P2, which correspond to the thicknesses of the plural sheets of paper P, by experimentation using the actual image forming apparatus 10 and sheets of paper of the plural thicknesses. Further, a linear expression representing a relationship between the thickness T of the paper P and the difference is derived in advance by approximating the pre-derived difference to the primary straight line using the least square method.

Then, the image forming apparatus 10 derives the thickness T of the paper P based on the difference, using the linear expression.

Next, with reference to FIG. 9, the operation of the image forming apparatus 10 according to the present exemplary embodiment at the time of execution of the detection function will be described. In addition, since the operation of the image forming apparatus 10 according to the present exemplary embodiment is different from each exemplary embodiment in the process of step S160, the process of step S160 will be described here.

In step S160 in FIG. 9, the CPU 100 derives the thickness T of the paper P, based on a difference between the upwardly convex peak value P1 and the downwardly convex peak value P2, of the time series data of the voltage value V that is acquired by the process of repeating step S154 to step S158, using the pre-obtained linear expression.

Fourth Exemplary Embodiment

Hereinafter, a fourth exemplary embodiment of the present invention will be described in detail. In addition, since the configuration of the image forming apparatus 10 according to the present exemplary embodiment is the same as in the first exemplary embodiment (see FIGS. 1 and 2), a description thereof will be omitted here.

First, the detection function according to the present exemplary embodiment will be described. The image forming apparatus 10 according to the present exemplary embodiment derives the thickness T of the paper P based on a difference between the voltage value V that is output from the torque detector 114 and the peak value P2, during a predetermined period (hereinafter, referred to as "second period") in a period in which the paper P is transported by both a set of the intermediate transfer belt 42 and the second transfer roll 22, and the fixing device 24. In addition, the period in which the paper P is transported by both of them corresponds to a period from the timing t1 to the timing t2, illustrated in FIG. 3.

Specifically, the image forming apparatus 10 derives the average value of the voltage values V during the second period. In addition, as long as the second period is within a period from the timing t1 to the timing t2, the second period is not particularly limited. The second period may be a period including the center of the period from the timing t1 to the timing t2, of a predetermined proportion (for example, 50%) to the entire period, may be a period of the proportion immediately preceding the timing t2, or may be the entire period from the timing t1 to the timing t2.

Then, the image forming apparatus 10 derives the thickness T of the paper P based on a difference between the derived average value and the peak value P2. As illustrated in FIG. 3, the difference between the average value and the peak value P2 is increased as the paper P becomes thicker.

Therefore, in the present exemplary embodiment, similar to each exemplary embodiment, the image forming apparatus 10 derives in advance a difference between the average value and the peak value P2, which correspond to the thicknesses of the plural sheets of paper P, by experimentation using the actual image forming apparatus 10 and sheets of paper of the plural thicknesses. Further, a linear expression representing a relationship between the thickness T of the paper P and the difference is derived in advance by approximating the pre-derived difference to the primary straight line using the least square method.

Then, the image forming apparatus 10 derives the thickness T of the paper P based on the difference between the average value during the second period and the peak value P2, using the linear expression.

Next, with reference to FIG. 9, the operation of the image forming apparatus 10 according to the present exemplary embodiment at the time of execution of the detection function will be described. In addition, since the operation of the image forming apparatus 10 according to the present exemplary embodiment is different from each exemplary embodiment in the process of step S160, the process of step S160 will be described here.

In step S160 in FIG. 9, the CPU 100 derives the average value of the voltage values V that are acquired by the process of step S154 within the second period. Then, the CPU 100 derives the thickness T of the paper P, based on the difference between the derived average value and the peak value P2, using the pre-obtained linear expression.

Fifth Exemplary Embodiment

Hereinafter, a fifth exemplary embodiment of the present invention will be described in detail. In addition, since the configuration of the image forming apparatus 10 according to the present exemplary embodiment is the same as in the first exemplary embodiment (see FIGS. 1 and 2), a description thereof will be omitted here.

First, the detection function according to the present exemplary embodiment will be described. The image forming apparatus 10 according to the present exemplary embodiment derives the thickness T of the paper P based on a difference between the voltage value V that is output from the torque detector 114 and the peak value P2, during a predetermined period (hereinafter, referred to as "third period") in a period before the paper P enters the fixing device 24. In addition, the period before the paper P enters the fixing device 24 corresponds to a period preceding the timing t1 illustrated in FIG. 3.

Specifically, the image forming apparatus 10 derives the average value of the voltage values V during the third period. In addition, as long as the third period is within a period preceding the timing t1, the third period is not particularly limited. The third period may be a period including the center of a period from 0 on the left end illustrated in FIG. 3 (a timing at which the leading edge of the paper P has passed the detection position by the paper detection sensor 80) to the timing t1, of a predetermined proportion (for example, 50%) to the entire period, may be a period of this proportion immediately preceding the timing t1, or may be the entire period from 0 on the left end to the timing t1, illustrated in FIG. 3.

Then, the image forming apparatus 10 derives the thickness T of the paper P based on the difference between the derived average value and the peak value P2. As illustrated in FIG. 3, the difference between the average value and the peak value P2 is increased as the paper P becomes thicker.

Therefore, in the present exemplary embodiment, similar to each exemplary embodiment, the image forming apparatus 10 derives in advance a difference between the average value and the peak value P2, which correspond to the thicknesses of the plural sheets of paper P, by experimentation using the actual image forming apparatus 10 and sheets of paper of the plural thicknesses. Further, a linear expression representing a relationship between the thickness T of the paper P and the difference is derived in advance by approximating the pre-derived difference to the primary straight line using the least square method.

Then, the image forming apparatus 10 derives the thickness T of the paper P based on the difference between the average value during the third period and the peak value P2, using the linear expression.

Next, with reference to FIG. 9, the operation of the image forming apparatus 10 according to the present exemplary embodiment at the time of execution of the detection function will be described. In addition, since the operation of the image forming apparatus 10 according to the present exemplary embodiment is different from each exemplary embodiment in the process of step S160, the process of step S160 will be described here.

In step S160 in FIG. 9, the CPU 100 derives the average value of the voltage values V that are acquired by the process of step S154 within the third period. Then, the CPU 100 derives the thickness T of the paper P, based on the difference between the derived average value and the peak value P2, using the pre-obtained linear expression.

Hitherto, the respective exemplary embodiments have been described, but the technical scope of the present invention is not limited to the scope described in the respective exemplary embodiments. Various changes or modifications in the respective exemplary embodiment may be added within the scope without departing from the spirit of the present invention, and the exemplary embodiments added with the changes or improvements are also included in the technical scope of the present invention.

Further, the respective exemplary embodiments may not limit the invention according to the claims, and all combinations of features described in the respective exemplary embodiments are not always required for resolving units of the invention. The respective exemplary embodiments described above include inventions of various stages, and various inventions may be extracted by a combination of the disclosed plural constituent features. Even if some constituent components are deleted from all constituent components disclosed in the respective exemplary embodiments, as long as the effect is achieved, the configuration in which some constituent components are deleted may be extracted as the invention.

For example, in the respective exemplary embodiments, the case has been described in which the fixing device 24 is applied as the transport unit of the present invention, but the present invention is not limited thereto. For example, other transport units such as the set of the intermediate transfer belt 42 and the second transfer roll 22, or the positioning roll 68, which transport the image formed surface of the paper P by interposing the surface may be applied as the transport unit of the present invention. Even in this case, similar to the respective exemplary embodiments, the thickness of the paper P is derived based on the load of the driving unit that drives the transport unit.

Further, when the transport unit provided in the upstream of the transporting path is applied as the transport unit of the present invention, members in the downstream of the transporting path may be controlled based on the derived thickness of the paper P.

In this case, for example, similar to the respective exemplary embodiments, the thickness of the paper P is derived based on the load (torque) of the motor that drives the positioning roll 68. An aspect is exemplified in which the voltage value of the second transfer voltage applied to the assist roll 50 is changed depending on the derived thickness of the paper P. Further, an aspect is exemplified in which the transport speed of the paper P in the transporting path 60 in the downstream of the positioning roll 68 is changed depending on the derived thickness of the paper P, or an aspect of changing the amount of heat that is heated by the heat belt 24A is also exemplified.

Further, in the respective exemplary embodiments, the case has been described in which the transport speed of the paper P by the second transport unit (the intermediate transfer belt 42 and the second transfer roll 22) on the upstream side of the transport unit is faster than the transport speed of the paper P by the transport unit (fixing device 24), but the present invention is not limited thereto. For example, the transport speed of the paper P by the second transport unit may be slower than the transport speed of the paper P by the transport unit.

Figure 11:
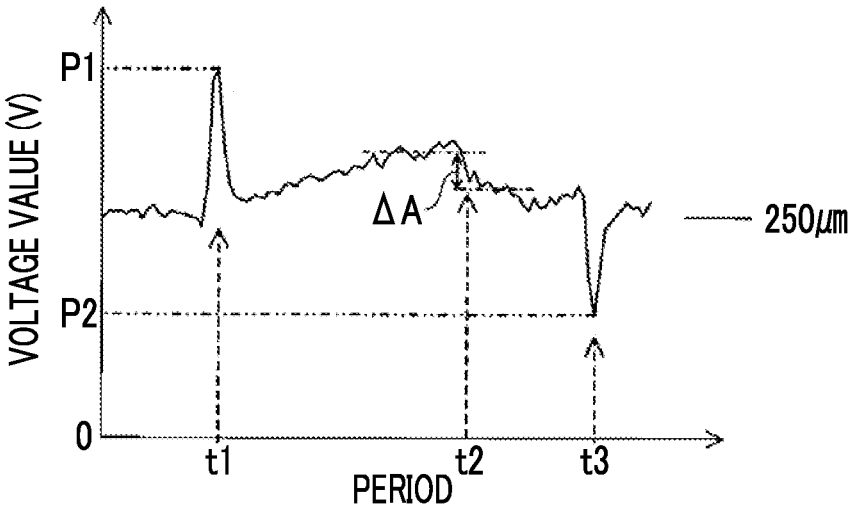
FIG. 11 is a graph illustrating an example of time series data of a detection result by a torque detector according to a modification example.

FIG. 11 illustrates a graph corresponding to FIG. 3 of the respective exemplary embodiments, in this exemplary embodiment. Similar to FIG. 3, FIG. 11 illustrates an example of time series data of the voltage value that is output from the torque detector 114, from a timing when the leading edge of the paper P has passed the detection position by the paper detection sensor 80 to a timing when the trailing edge of the paper P has passed the detection position by the paper detection sensor 82. Further, the timings t1, t2, and t3 in FIG. 11 correspond to the timings t1, t2, and t3 in FIG. 3. Even in this exemplary embodiment, similar to the respective exemplary embodiments, the thickness of the paper P is derived using the peak value P2.

Further, in each exemplary embodiment, the case has been described in which a thickness derivation processing program is installed in advance in the ROM 102, but the present invention is not intended to be limited thereto. For example, the thickness derivation processing program may be provided by being stored in a storage medium such as a compact disk read only memory (CD-ROM), or may be provided through a network.

Further, in the respective exemplary embodiments, the case has been described in which the thickness derivation process is realized by a software configuration using a computer, by executing the program, but the present invention is not limited thereto. For example, the thickness derivation process may be realized by a hardware configuration, or a combination of hardware and software configurations.

In addition, the configuration of the image forming apparatus 10 described in each exemplary embodiment (see FIGS. 1 and 2) is an example, and it goes without saying that unnecessary portions may be deleted or new parts may be added, within the scope without departing from the spirit of the present invention.

Further, the flow of the process of the thickness derivation processing program (see FIG. 9) described in each exemplary embodiment is an example, and it goes without saying that unnecessary steps may be deleted, new steps may be added, or the processing order may be replaced, within the scope without departing from the spirit of the present invention.

Further, the configuration of the error notification screen (see FIG. 10) described in each exemplary embodiment is an example, and it goes without saying that some pieces of information may be deleted, new pieces of information may be added, or the display position may be changed, within the scope without departing from the spirit of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a transport unit configured to transport a recording medium by interposing the recording medium;

a driving unit configured to drive the transport unit;

a detection unit configured to detect a peak value of a load of the driving unit in response to the recording medium being discharged from the transport unit; and a derivation unit configured to derive a thickness of the recording medium based on the peak value detected by the detection unit, wherein the peak value is a voltage value, wherein the derivation unit is further configured to derive the thickness based on a difference between an average of voltage values, obtained during a first period, and a peak voltage value, obtained after the first period, wherein the first period is a period of time in which a first pair of rollers of the transport unit transfers the recording medium to a second pair of rollers, and wherein the derivation unit is further configured to derive the thickness based on a difference between a maximum voltage value and a minimum voltage value obtained during transport of the recording medium by the transport unit.

2. The transport device according to claim 1, further comprising:

a second transport unit that is disposed on an upstream side of the transport unit in a transport direction of the recording medium, and is configured to transport the recording medium by interposing the recording medium, wherein the detection unit is further configured to detect a load of the driving unit during a first period from a timing in response to the recording medium is discharged from the second transport unit to a timing in response to the recording medium being discharged based on the transport unit, and wherein the derivation unit is further configured to derive a thickness of the recording medium based on a difference between the peak value and the load during the first period, the peak value and the load being detected by the detection unit.

3. The transport device according to claim 1, wherein the detection unit is further configured to detect a peak value of a load of the driving unit in response to the recording medium entering the transport unit, and wherein the derivation unit is further configured to derive a thickness of the recording medium based on a difference between the peak value at a time when the recording medium is discharged and the peak value at a time when the recording medium enters the transport unit, the peak values being detected by the detection unit.

4. The transport device according to claim 1, further comprising:

a second transport unit that is disposed on an upstream side of the transport unit in a transport direction of the recording medium, and is configured to transport the recording medium by interposing the recording medium, wherein the detection unit is further configured to detect a load of the driving unit during a second period in which the recording medium is transported by both the transport unit and the second transport unit, and wherein the derivation unit is further configured to derive the thickness of the recording medium based on a difference between the peak value and the load during the second period, the peak value and the load being detected by the detection unit.

5. The transport device according to claim 1, wherein the detection unit is further configured to detect a load of the driving unit during a third period before the recording medium enters the transport unit, and wherein the derivation unit is further configured to derive a thickness of the recording medium based on a difference between the peak value and the load during the third period, the peak value and the load being detected by the detection unit.

6. The transport device according to claim 1, further comprising:

a correction unit that is disposed on an upstream side of the transport unit in a transport direction of the recording medium, and is configured to correct an inclination of the recording medium with respect to the transport direction.

7. An image forming apparatus comprising:

an image forming unit that is configured to form an image on a recording medium; and the transport device according to claim 1 configured to transport the recording medium.

8. The image forming apparatus according to claim 7, wherein the transport unit is a fixing device configured to fix the image on the recording medium.

* * * * *